US005390371A

United States Patent [19]

Sigward

[11] Patent Number: 5,390,371

[45] Date of Patent: Feb. 21, 1995

[54] GUITAR GLOVE

[76] Inventor: Richard A. Sigward, 3224 Rock Hill Rd., East Alton, Ill. 62024

[21] Appl. No.: 62,981

[22] Filed: May 18, 1993

[51] Int. Cl.[6] ..... A41D 19/00

[52] U.S. Cl. ..... 2/159; 2/161.6

[58] Field of Search ..... 2/159, 161.6, 163, 161.3, 2/161.4, 160

[56] References Cited

U.S. PATENT DOCUMENTS

| | | | |
|---|---|---|---|
| Re. 22,167 | 8/1942 | Wells et al. | 2/159 |
| D. 264,893 | 6/1982 | Schroeder . | |
| 548,541 | 10/1895 | Heafield | 2/159 |
| 1,206,102 | 11/1916 | Gibson | 2/159 |
| 2,167,226 | 7/1939 | Wells et al. | 2/159 |
| 2,783,759 | 3/1957 | Hill | 2/159 |
| 3,283,338 | 11/1966 | Landau | 2/161.6 |
| 3,387,306 | 6/1968 | Korey | 2/159 |
| 4,742,579 | 5/1988 | Dunford . | |
| 5,031,239 | 7/1991 | Panichello et al. . | |
| 5,033,120 | 7/1991 | Myers . | |

*Primary Examiner*—Clifford D. Crowder
*Assistant Examiner*—Gloria Hale
*Attorney, Agent, or Firm*—Don W. Weber

[57] ABSTRACT

A tight fitting guitar glove is presented which has a number of raised cushioning strips on the tips of each of the four fingers of the glove. Several longer raised cushioning strips are also placed on the thumb side of the length of the index finger. These raised strips are used to compress the chord strings on the guitar. The strips are quite narrow, being approximately 1/16" in width and have valleys between the raised strips. The cloth of the glove is extremely tight fitting so that only the raised strips on the tip or side of the fingers will touch the closely adjacent guitar strings. The raised cushioning strips not only provide comfort to the guitar player but are so designed as to allow for the strips to depress closely spaced guitar strings.

4 Claims, 2 Drawing Sheets

GUITAR GLOVE

BACKGROUND OF THE INVENTION

This invention relates to the field of musical instrument accessories and more particularly to a guitar glove for use in playing the guitar.

The guitar is a musical instrument played by strumming or plucking a plurality of strings running from the neck to the body of the guitar. The original, wooden guitar consisted of an elongated neck attached to a hollow soundbox. Modern electric guitars look similar to the original type of guitar but do not have a hollow soundbox, replacing that with a solid body. In either type of guitar, the music is produced by plucking or strumming the plurality of strings with one hand while simultaneously varying the length of the strings by pressing one or more strings down at the neck of the guitar with the other hand.

A number of different devices have been devised to aid or in some cases improve upon the ability of the fingers of each hand to manipulate the strings. A guitar pick is frequently used in order to facilitate strumming or plucking of the strings by the right hand. However, there have been no devices directed towards the improvement of the ability of the guitar player to lengthen or shorten the length of each string by depressing the string along its length when using the left hand. (Of course, the function of the left and right hands are reversed should the guitar player be predominantly left handed rather than right handed.) The guitar glove aids the player in depressing the strings.

One problem encountered in the use of the left, or chord hand, is encountered by the stress and deterioration of the tips of the fingers as they are used to press down on the various strings.

Guitar strings vary in width but come in very small diameters as a general rule. The strings are tightly stretched along the neck of the guitar and it is often times quite difficult to press these strings down with the chord-hand fingers. Additionally, rapid changing of the chords often causes the guitar player to slide the tips of his bare fingers along these strings which creates further deterioration of the bare skin on the tips of the fingers.

It is an object of this invention to provide a guitar glove with specially designed tips for manipulating the narrow spaces between the strings on the neck of a guitar. It is another object of this invention to provide a guitar glove which cushions and helps to maintain the tips of the fingers by using small cushioning strips where the tips of the fingers would normally be required to press on the guitar strings to produce chords. A still further object of this invention is to provide a snug fitting guitar glove having cushioning tips providing a comfortable and effective means of manipulating the chords on the neck of the guitar.

Other and further objects of this invention will become apparent upon reading the following described Specification.

BRIEF DESCRIPTION OF THE INVENTION

A tight fitting guitar glove is presented for use on the chord hand of a guitar player. The glove is made of skin-tight fitting material such as stretch nylon or spandex. The glove fits tightly against the guitar player's chord hand. The finger for the thumb is cut off near the palm of the hand so that the thumb of the guitar player is free to grip the guitar with the natural skin surface.

On the fingertips of each finger, as well as along the radial side of the index finger are placed narrow cushioning strips. These raised strips are placed so that the fingertips of the guitar player are able to press down individual, closely spaced, guitar strings. The cushioning strips have the effect of rendering the guitar player readily able to depress the strings at the appropriate spot while cushioning the harsh impact of the strings from the natural skin of the guitar player. The glove is skin tight and the strips are arranged so that the glove itself does not impinge on any adjacent strings. The effect of the guitar glove is to allow the guitar player to play with much more comfort and longevity, due to the cushioning effect of the strips.

DETAILED DESCRIPTION OF THE PREFERRED EMBODIMENT

Figure 1:
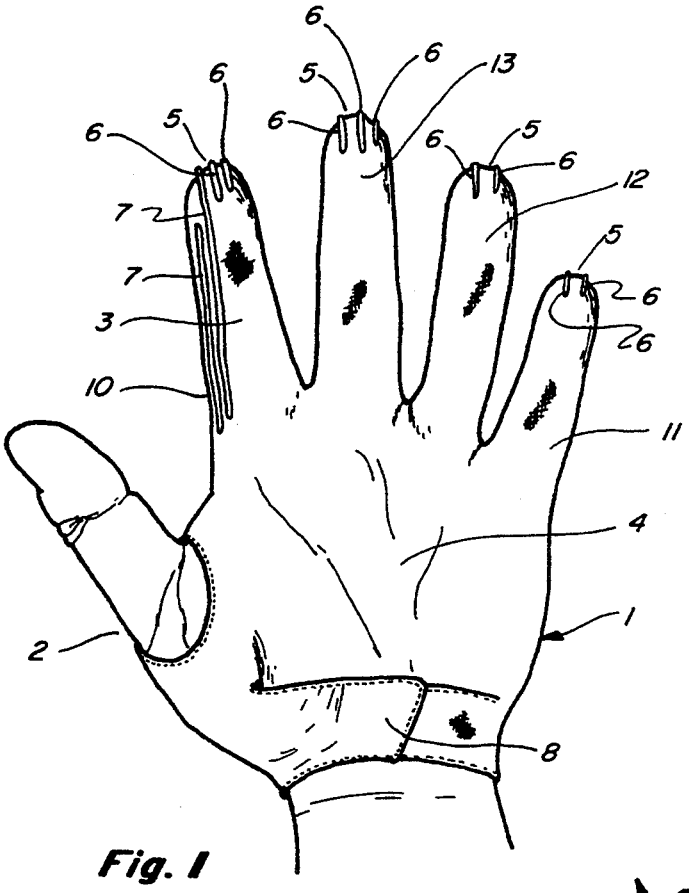
FIG. 1 is a top plan view of the left, or chord, hand of the guitar player, showing the glove on the hand, with the palm facing upwards.

A guitar is generally played by gripping the neck of the guitar with the left, or chord, hand of a right handed guitar player. The right hand is then used to pluck or strum the strings near the body of the guitar. As best shown in FIG. 1, the unique cushioning guitar glove 1 is shown placed over the human hand. The guitar glove has the thumb portion 2 removed, so as to allow the guitar player to grip the neck of the guitar with the bare thumb.

The index finger 3 of the chord hand glove, as well as the other fingers, are present as is normally the case with a regular glove. FIG. 1 shows the palm side 4 of the guitar chord hand and glove.

The fingertips 5 of the four fingers have a plurality of raised cushioning strips 6 placed longitudinally at the ends as shown on FIG. 1.

The raised cushioning strips 6 are located longitudinally, and, in the preferred embodiment, comprise two narrow spaced strips 6 on the little finger 11 and the finger adjacent to the little finger 12. The middle finger 13 and the index finger 3 also have a plurality of elongated raised cushioning strips 6 at the very tip end 5 of the finger. For the index and middle finger, the preferred embodiment has three spaced elongated raised cushioning strips.

In playing the guitar, the radial side 10 of the index finger 3 may frequently be used to cover all of the strings of the guitar. (The index finger has two sides, the radial side (near the thumb) and the ulnar side (near the middle finger).) To provide for this possibility, a plurality of elongated raised cushioning strips 7 are placed along the length of the index finger 3 near the radial side 10 of the finger.

Figure 2:
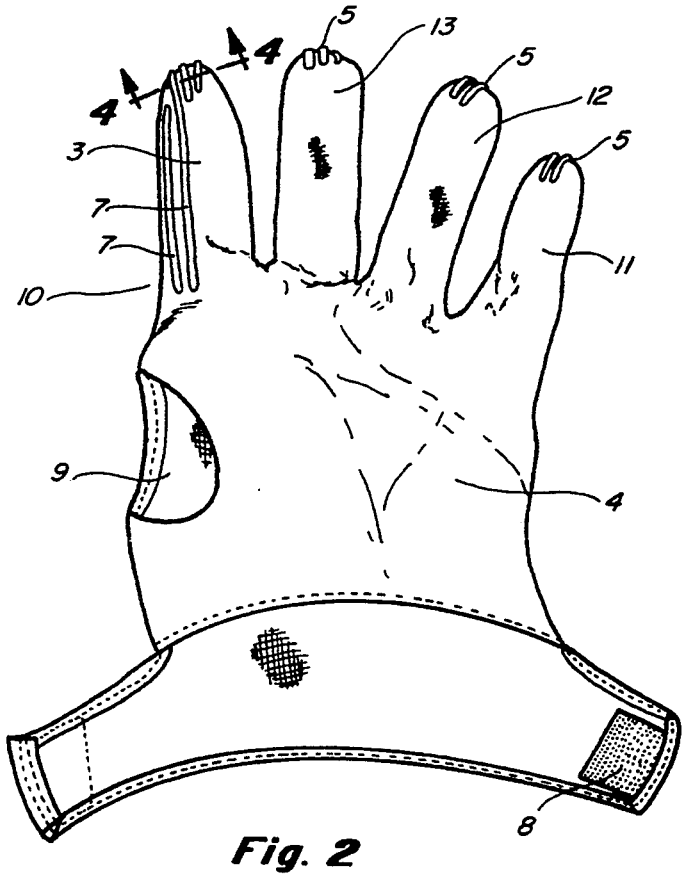
FIG. 2 is a top plan view of the palm side of the glove of FIG. 1, without the human hand.
Figure 3:
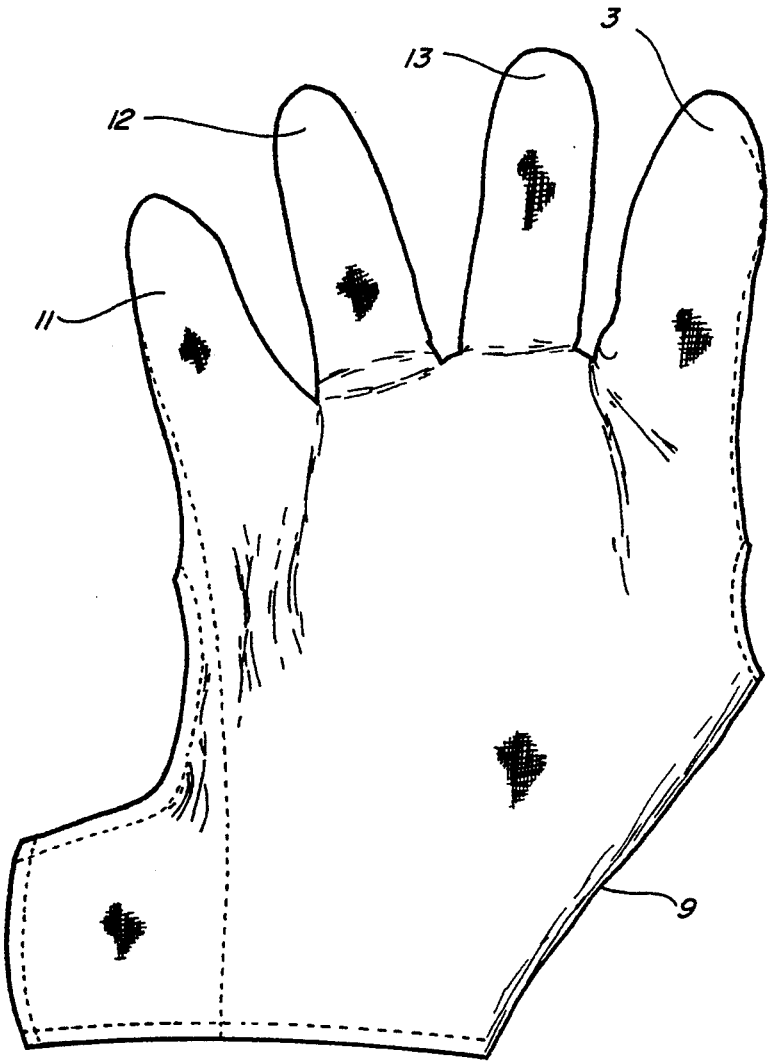
FIG. 3 is a top plan view of the guitar glove shown from the direction of the top of the glove, opposite the palm side.

The glove itself is fastened much as the normal baseball glove, golf glove, or other athletic glove, by means of a wrist closure 8 as best shown in FIGS. 2 and 3.

The top side of the glove as shown in FIG. 3 appears as a normal glove would appear with the exception of the cutaway section 9 for the thumb.

Figure 4:
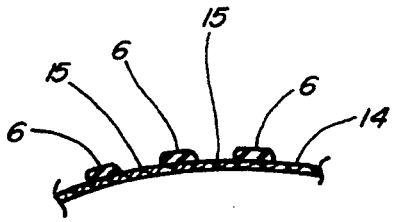
FIG. 4 is an expanded side cutaway view of the raised cushioning strips on the fingertips of the glove, shown along line 4—4 of FIG. 2.

As best shown in FIG. 4, the raised elongated strips 6 protrude slightly above the tightly fitting surface 14 of the glove. The preferred embodiment, as shown on FIG. 1, has two strips on the little finger and finger adjacent to the little finger, while it has three strips on the middle and index fingers.

Figure 5:
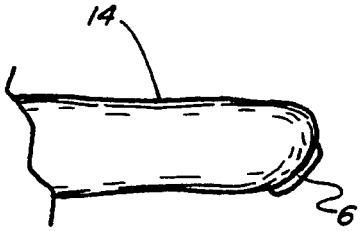
FIG. 5 is a side view of one finger of the cushioning glove, showing the skin tight nature of the glove and the location of the raised cushioning strip.

The raised cushioning strips 6 as shown on the drawings figures are more particularly described on Drawing FIGS. 4 and 5. On Drawing FIG. 4, which is a cross section of a portion of Drawing FIG. 2, the elevated cushioning strips 6 create ridges and depressed valleys 15 as shown.

The elevated ridges 6 shown in cross section are provided so that the various chord strings may be depressed without utilizing the entire width of the normal finger. This is necessary because the strings of the guitar are so close together. These raised cushioning strips 6 are quite narrow, being approximately 1/16" in width. The valleys are approximately ¼" in width, thus separating the elevated cushioning strips 6.

As shown on FIG. 5, the glove surface 14 is made to be tight fitting. To aid in this purpose the glove should be made of spandex, tight fitting nylon, or other material which would have the characteristic of being nearly skin tight around the fingers. It is also important in making this device that no bulky cloth or other material remain on the end of the finger. Such cloth would muffle the string next to the one being depressed and produce an inappropriate sound from the guitar.

While the glove pictured would be a full glove, it is also made to be tightened by the fastener 8. This fastener may be made of VELCRO hook and pile fasteners, snaps or other similar devices. As shown on FIG. 5, the tightly fitting glove has raised cushioning strips 6 on the tips of the fingers.

The cushioning strips themselves could be made of any appropriate material, but a type of solid rubber is preferred. Any other type of similar synthetic material could also be applied to the tips of the fingers to provide the lengths of raised cushioning strips 6 and raised long cushioning strips 7 as shown in the drawings, and leather cushioning strips are an alternative suitable choice.

The guitar glove would be used mainly by professional guitarists, who need to use their fingers for long periods at a time. However, it could also be used for amateur guitar players as the salutary effects of the cushioning and protecting glove would approve the ability of the guitar player to play his instrument. While the preferred embodiment is described and shown above, slight variations are clearly within the contemplation and spirit of this invention.

Having fully described my device, I claim:

1. A guitar glove comprising:

(1) a tight fitting glove made of stretch nylon, or its equivalent, wherein the thumb section is removed;

(2) wherein each very tip end of the index and middle fingers of said glove has a plurality of raised, elongated cushioning strips, said strips running parallel to the length of said fingers; and (3) wherein each very tip end of the remaining fingers has a plurality of raised, elongated cushioning strips, said strips running parallel to the length of said fingers;

(4) further comprising a plurality of raised, elongated cushioning strips running the length of the radial side of the index finger;

whereby said glove tightly fits about a guitar player's hand and said tip end cushioning strips enable him to depress individual guitar strings.

2. A guitar glove comprising:

(1) a tight fitting glove made of stretch nylon, or its equivalent, wherein the thumb section is removed;

(2) wherein each very tip end of the index and middle fingers of said glove has three raised, elongated cushioning strips, said strips running parallel to the length of said fingers; and (3) wherein each very tip end of the remaining fingers has two raised, elongated cushioning strips, said strips running parallel to the length of said fingers;

(4) further comprising a plurality of raised, elongated cushioning strips running the length of the radial side of the index finger;

whereby, said glove tightly fits about a guitar player's hand and said tip end cushioning strips enable him to depress individual guitar strings.

3. A guitar glove, as in claim 2, wherein said raised, elongated cushioning strips are approximately 1/16" high and are separated by valleys approximately ¼" wide, whereby individual chord strings of a guitar may be depressed by a guitarist wearing said gloves.

4. A guitar glove, having finger, palm and wrist portions, as in claim 2, further comprising a closure at the wrist portion of said glove.

* * * * *